United States Patent [19]

Belter et al.

[11] Patent Number: 4,780,939

[45] Date of Patent: Nov. 1, 1988

[54] FASTENER FOR BANDS OR THE LIKE

[75] Inventors: Lothar Belter; Gustav Christians; Erich Klingenburg, all of Wuppertal, Fed. Rep. of Germany

[73] Assignee: Schaeffer Verbindungstechnik GmbH, Wuppertal, Fed. Rep. of Germany

[21] Appl. No.: 82,826

[22] Filed: Aug. 5, 1987

[30] Foreign Application Priority Data

Aug. 25, 1986 [DE] Fed. Rep. of Germany ..... 3628771

[51] Int. Cl.[4] ..... A44B 11/00; A44B 19/00

[52] U.S. Cl. ..... 24/585; 24/68 R; 24/191; 24/698

[58] Field of Search ..... 24/585, 698, 387, 191, 24/68 R

[56] References Cited

U.S. PATENT DOCUMENTS 3,113,362 12/1963 Petruzziello ..... 24/585
3,872,554 3/1975 Wolfertz et al. ..... 24/191
4,466,162 8/1984 Pogharian et al. ..... 24/585
4,545,096 10/1985 Belter et al. ..... 24/585
4,683,620 8/1987 Valsecchi et al. ..... 24/585

*Primary Examiner*—Victor N. Sakran
*Attorney, Agent, or Firm*—Martin A. Farber

[57] ABSTRACT

A fastener for a band or the like, particularly a waistband on garments, comprising a rail provided with detents, the rail being fastened to one end of the band. A slide travels on the rail, the slide being fastened to the other end of the band. An angle-shaped flip lever has a shorter angle leg which, in a flipped position of the flip lever, engages into the detent depressions of the rail, the flip lever being carried by the slide. The flip lever has a window for the free passage of a cover strip lying on the outside in front of the rail, the flip lever including a longer angle leg which extends outward of the fastener in operating position leg. A snap-detent connection secures a covering to the longer leg, the snap-detent connection being formed by providing the convering with an opening into which a tongue of the longer leg extends. The opening is developed as an insertion pocket, open towards the window, for the tongue, the wide surface of which enters into a detent connection with the pocket wall.

7 Claims, 4 Drawing Sheets

FASTENER FOR BANDS OR THE LIKE

FIELD AND BACKGROUND OF THE INVENTION

The present invention refers to fastener for bands or the like, particularly waistbands on trousers, skirts, pockets or the like, consisting of a rail provided with detents which is fastened to one end of the band and of a slide traveling on said rail, the slide being fastened to the other end of the band and having an angle-shaped flip lever whose shorter angle leg engages in the closed position of the flip lever into the detent depressions of the detent rail, and has a window for the free passage of a cover strip which lies on the outside in front of the rail and the longer angle leg of which lies exposed towards the outside as operating section, said longer angle arm being provided with a covering fastened by means of a snap-detent connection in the manner that the covering has an opening into which a tongue of the angle leg extends.

A fastener of this type is known from the applicant's Federal Republic of Germany No. OS 33 24 657. The locking takes place there on the tongue-side frame arm of the window while the tongue itself is seated in the opening which is of corresponding cross section. By means of the covering, color matching to the specific article of clothing with which the fastener is used can, in particular, be obtained.

SUMMARY OF THE INVENTION

The object of the invention is to develop the snap-detent connection of such a fastener in a structurally simpler and easier manner.

According to the invention the opening is developed as an insertion pocket, open towards the window, for receipt of the tongue, the wide surface of which enters into a detent connection with a wall of the pocket.

As a result of this development the provision of the flip lever is substantially simplified without loss in stability. There is no longer required the position-fixing snap association followed by transverse shifting of the plate in order to effect the gripping-over snap connection to the frame arm. Rather, a simple linear plug association is sufficient. The cover is then immediately firmly seated. The structural means for this are simple and suitable. Thus one has proceeded here in the manner that the opening is developed as pocket open towards the window for the insertion of the tongue, the wide surface of which enters into a detent connection with the pocket wall. Anti-removal interlocking and insertion seat are thus combined in one region. Furthermore, it has proven advantageous for the broad side of the pocket wall to have an entrance space for a detent projection of the tongue. The use of the broad side permits the development of a correspondingly large detent projection. This leads to a good rear anchoring engagement. It is furthermore proposed that the cover be framed by an edging and that longitudinally extending stabilizing ribs extend from the pocket side walls, the ribs being rooted also in the edging section which extends transverse thereto on the end side. A development of the flip lever which is extremely sparing in material but nevertheless very stable can be obtained by simple means in the manner that the insertion pocket is arranged in the region of that half of the cover which faces the window opening. This half thus results in a double layer (tongue plus covering plate). The other half, which forms the free end of the flap lever, remains, on the other hand, elastic or flexible corresponding to the plastic material selected, so that, forces from a given band constellation which act there for example in the opening direction do not lead directly to a swinging of the flip lever into the open position; rather, a definitely intended manner of actuation is needed which possibly even requires a slight bending. Finally, it has also proven favorable for the association that the window-side end section of the cover lie within a depression, formed by bending, on the top of the frame arm which participates in the forming of the window. This has two advantages: On the one hand, the frame edge there is gripped over, so that a favorable protection against wear is provided for the cover strip, while on the other hand, an additional support for the covering can be useful in this region. A flat resting between cover and corresponding tongue surface is obtained in favorable manner despite the provision of an edging because the edging has an interruption in the region of the inserted end section. Finally, it is also proposed that the wide side wall of the pocket debouch into a freely protruding tab the base line of which lies approximately at the height of the window-side edge of the entrance space. The freely protruding tab is readily movable so that basically the entire pocket region is not subject to any deformation upon the case of the snap-detent connection itself. On the other hand, the tab which then snaps behind the detent projection results in an excellent detent anchoring.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
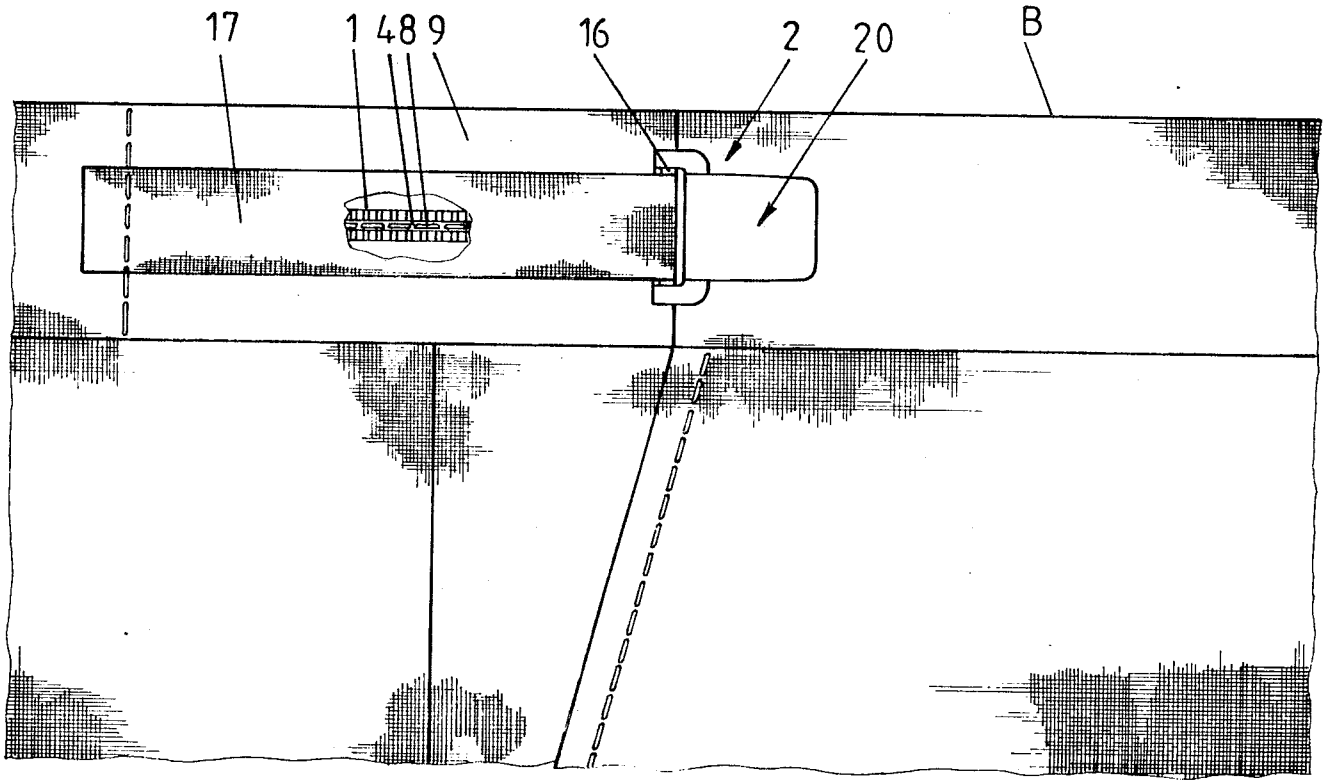
FIG. 1 shows the fastener of the invention in side view on the waistband of trousers.

The fastener, which is guided in carriage-like manner on a detent rail 1 associated with the waistband has a flip lever 2 as well as a slider bottom plate 3 serving as support for same. The last-mentioned two parts consist of metal; the detent rail consists of resilient plastic.

The detent rail 1 has transverse detent depressions 5, generally divided by a centrally extending sew-on depression 4. The rail base 6 is pulled in. This pulling in is gripped under by doubly angularly bent guide tabs 7 which are cut free out of the material of the slider bottom plate 3.

A sewed seam 8 holds the detent rail 1 and therefore the fastener on the one end A of the band 9 of the trousers.

The angle-shaped flip lever 2 has a shorter angle leg 10 and a longer angle leg 11. These angle legs lie at an obtuse angle to each other. The flip angle is formed by two sections 12' of a frame arm 12 of the shorter angle leg 10. The sections 12' lie in bearing eyes 13 of the slider bottom plate 3. These bearing eyes 13 are formed by edge tongues of the slider bottom plate 3 which are cut free and essentially circularly rolled.

The longer angle leg 11 of the flip lever 2 has a window 16 which commences immediately behind the shorter leg 10. This window allows the free passage of a cover strip 17 which is arranged outside of the detent rail 1 and fastened at its two ends to the band 9. The width of the window corresponds approximately to the width of the cover strip 17. The cover strip 17, in its turn, is dimensioned wide enough to hide not only the detent rail 1 but also substantially the slider bottom plate 3 as well as the window frame arm 12. This window frame arm 12 engages with its middle section into the detent depressions 5 of the detent rail 1. It forms on this middle section a nose 19 which tips into the detent depressions 5 of the detent rail. The width of the nose 19 corresponds approximately to the width of the detent rail 1. The nose 19 passes through an opening left in the slider bottom plate 3 by the forming of the guide tabs 7.

Figure 2:
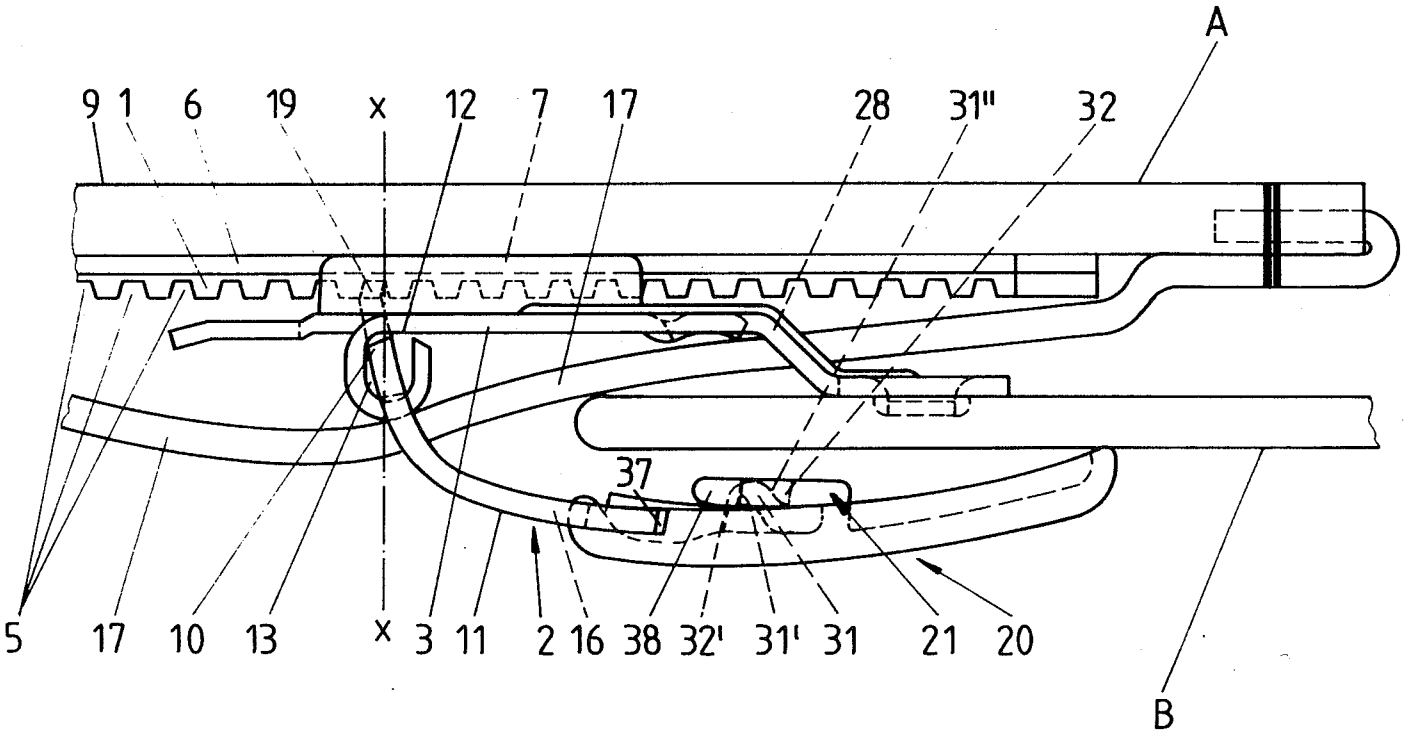
FIG. 2 is a top view of FIG. 1, but on a larger scale than in FIG. 1.
Figure 3:
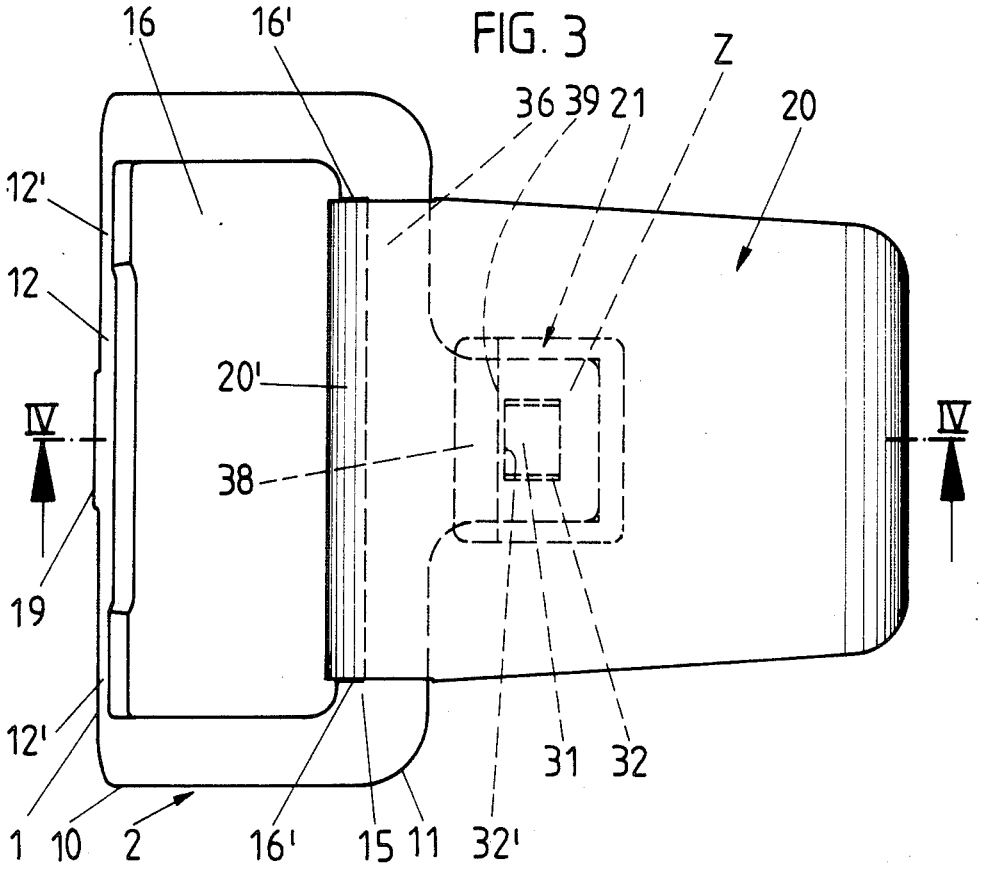
FIG. 3 is a top view of the flip lever provided with covering, shown by itself.

The window 16 is placed as deep as possible up into the vicinity of the slider bottom plate 3. This leads to a relatively small cross section of the frame arm 12 there. This, in its turn, favors springiness so that this frame arm 12, upon passage of the shorter angle leg 10 over the dead center line X—X (see FIG. 2) deflects briefly into the free space formed by the window 16. In this way a soft closing process is obtained. On the other hand, the restoring force inherent in the material favors the secure engagement with the detent rail 1.

In the closed position, the longer leg 11 which serves as actuating handle comes against the end B of the band 9. In this region, the slider bottom plate 3 is spaced somewhat from the detent rail 1. This is done by a bend region formed as a double oblique-angle bending of the slider bottom plate 3. The bend region has another window 28 for the passage of the cover strip 17, which thus also extends over the slider section which lies behind the band end B.

Figure 5:
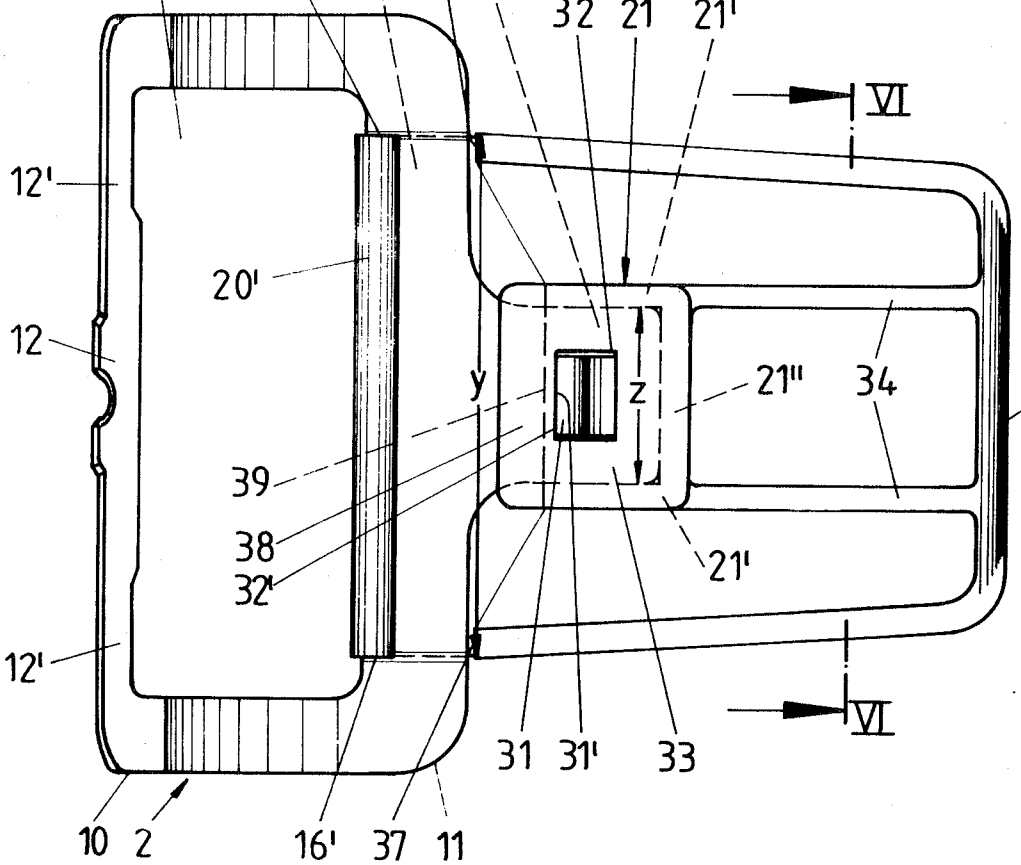
FIG. 5 is a bottom view of the covered flip lever.

The longer angle leg 11 of the flip lever 2 is provided with a covering 20 which is fastened in the manner of a snap-detent connection. It is a plastic injection molding in the form of a flat plate which, like the angle leg 11, is slightly arched in the direction of displacement of the slide. The greatest width y thereof (FIG. 5) is substantially larger than the width z of the longer angle leg 11 both widths being measured in a direction transverse to the longer leg 11. As can be noted from FIG. 5, the covering 20 has about three times the width z of the longer angle leg 11.

The snap-detent connection is produced in the manner that the free end of the longer angle arm forms a relatively small tongue Z which engages in form-fitting manner into an insert pocket 21 which is open towards the window 16. The means producing the detent connection are located on the broad surface of this tongue 3, namely in the form of a detent projection 31. The latter lies in the central region of the substantially square tongue Z.

The detent projection 31 consists of a jog which is cut free on three sides and bent in S shape in the direction of the band 9, its front end which extends parallel to the flip axis, i.e. the edge 31' of the detent projection 31, coming in locking fashion in front of the corresponding edge 32' of an entrance space 32 in the pocket wall 33 facing the detent rail 1.

As can be noted, the entrance space 32 is produced in the form of a window-like opening in the wall 33.

The back of the detent projection 31 which faces away from the obliquely arranged front end 31', on the other hand, has a run-on bevel 31'' which facilitates the snap-detent connection. The angle of inclination thereof to the plane of the plate or pocket is about 30 degrees.

The other pocket wall is formed practically of the plate-shaped body of the covering 20. The parallel pocket side walls 21' continue, extending over the pocket bottom 21'', in longitudinally extending web-like stabilizing ribs 34. They also extend continuously parallel to each other and are rooted at the end in a web-like edging section 35' of a surrounding edging 35. This edging stabilizes the relatively thin-wall covering 20. The stabilizing ribs 34, the edging section 35', and the remaining edging 35 extending in the lateral region of the covering 20 are all of the same height and, when the band fastener is closed, all point in the direction of the detent rail 1. The side edges of the covering 20 converge slightly towards the free end. Their corners there have a convex rounding.

As can be noted, the pocket 21 is located in the region of that half of the covering 20 which faces the window 16.

The window-side end section 20' of the covering 20 engages in bead-like manner into the cross-sectional region of the window 16 in such a manner that the window edge 15' formed by the frame arm 15 there of the window 16 is gripped over in protective manner by this end section 20'. The corresponding grip-over section of the covering is preferably transversely rounded there. In this way it is possible to dispense with a special finish for this window edge; the cover strip 17 is thereby imparted increased protection against wear. In the region of the end section 20', the frame arm 15 is furthermore developed shifted in plane in such a manner that on the surface of this frame arm 15 which participates in forming the window there is a depression 36 into which the section 20' enters flush or else only in part. The corresponding window engagement furthermore results in a lateral support against swinging of the covering 20 on the back-cut inner corner edges 16' of the window 16.

As can be seen, the edging 35 is interrupted in the region of the inward lying end section 20'. These interruptions are designated 37 (see FIG. 5).

Figure 4:
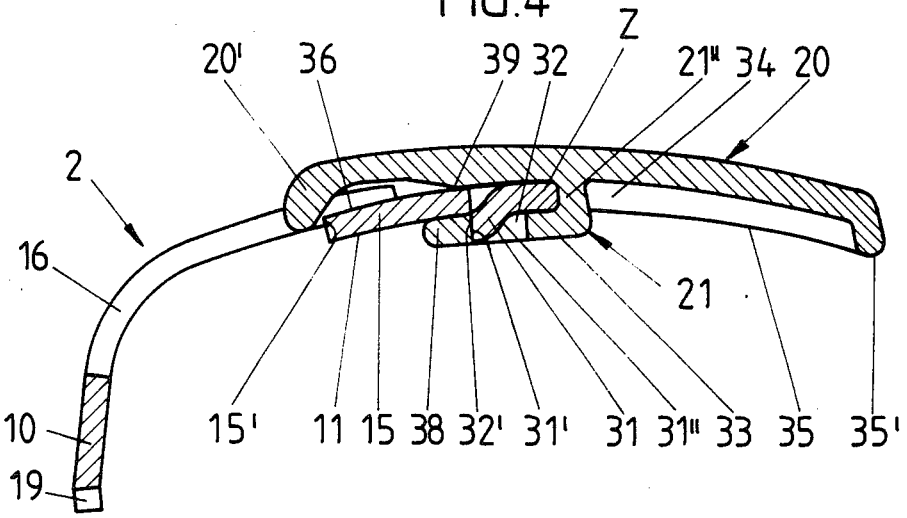
FIG. 4 is a section along the line IV—IV of FIG. 3.
Figure 6:
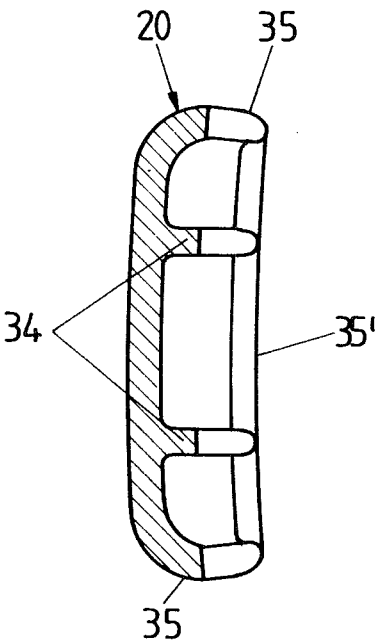
FIG. 6 is a section along the line VI—VI of FIG. 5.

The wide pocket wall 33 continues in a freely protruding awning-like tab 38. Its front edge is transversely rounded and thus favors the self-centering introduction of the tongue Z upon the snap-detent process. The corresponding free space results in a larger degree of movement upon the running under of the detent projection 31 since a corresponding transition connection to the pocket side wall 21 is lacking; in other words, the pocket is undercut. The pocket is therefore not excessively extended. On the other hand, there is a high degree of restoration. The pocket side root or base line of the freely protruding tab 38 extends approximately at the height of the window-side edge 32' of the entrance space 32. The dashed line 39 which can be noted in FIG. 5 corresponds to this base line and at the same time indicates a slightly increased wall thickness as compared with the general plate thickness of the other pocket wall formed by the plate of the covering 20, so that the pocket-forming zone is highly stable (see also FIG. 4).

A loosening of the covering, for instance in order to change this application, is only possibly intentionally by gripping under the tab 38 which then functions as opening aid, but this with simultaneously lifting of the cover end section 20' out of the window, after which lifting, however, the lateral support at the inner corner edges 16' of the window 16 also is done away with.

We claim:

1. A fastener for a band or the like, particularly a waistband on trousers, skirts, pockets and the like, comprising a rail provided with detents in the form of depressions, the rail being fastened to one end of the band;

a slide which travels on said rail, the slide being fastened to the other end of the band;

an angle-shaped flip lever having a shorter angle leg which, in a flipped position of the flip lever, engages into the detent depressions of the rail, the flip lever being carried by said slide, the flip lever having a window for the free passage of a cover strip lying on the outside in front of the rail, the flip lever including a longer angle leg with extends outward of the fastener in operating position;

a covering disposed on said longer leg;

a snap-detent connection for securing said covering to said longer leg, the snap-detent connection being formed by providing the covering with an opening into which a tongue of the longer leg extends; and wherein said opening is developed as an insertion pocket, open towards the window, for receipt of the tongue, the wide surface of which enters into a detent connection with a wall of the pocket.

2. A fastener according to claim 1 wherein the pocket wall is provided with an entrance space, the tongue having a detent projection to be received by the pocket entrance space.

3. A fastener according to claim 1, wherein said covering is framed by an edging, the covering having longitudinally extending stabilizing ribs which extend from side walls of the pocket, said ribs also being rooted in an edged section extending transversely of the rail on an end side of the pocket.

4. A fastener according to claim 1, wherein the invention pocket is arranged in the region of the covering which faces the window

5. A fastener according to claim 1, wherein a portion of said flip lever is formed as a frame enclosing the window, the frame having a depression formed by bending, located on the top of an arm of the frame; and a window-side end section of the covering lies in the frame depression.

6. A fastener according to claim 3, wherein the edging has an interruption in a region of an end section of the covering facing the window.

7. A fastener according to claim 2, wherein a wall of the pocket debouches into a free protruding tab located at an outer end portions of said flip lever, and a base line of the tab lies approximately in registration with an edge of the entrance space facing the window.

* * * * *